US007100318B1

(12) United States Patent
Beltz

(10) Patent No.: US 7,100,318 B1
(45) Date of Patent: Sep. 5, 2006

(54) ADJUSTABLE FIREARM SUPPORT

(76) Inventor: Kasey Dallas Beltz, 1262 Sunset Dr., Wichita, KS (US) 67212

( * ) Notice: Subject to any disclaimer, the term of this patent is extended or adjusted under 35 U.S.C. 154(b) by 0 days.

(21) Appl. No.: 11/136,034

(22) Filed: May 24, 2005

Related U.S. Application Data

(60) Provisional application No. 60/573,978, filed on May 24, 2004.

(51) Int. Cl.
*F41C 27/00* (2006.01)

(52) U.S. Cl. ..... 42/94; 248/274.1

(58) Field of Classification Search ..... 42/94; 89/37.04, 37.03, 37.12, 37.14; 248/274.1, 248/292.13, 288.4
See application file for complete search history.

(56) References Cited

U.S. PATENT DOCUMENTS 2,844,905 A * 7/1958 Musser et al. ..... 42/94
3,012,350 A 7/1961 Lies
3,327,422 A * 6/1967 Harris ..... 42/94
3,999,461 A * 12/1976 Johnson et al. ..... 89/191.01
4,351,224 A 9/1982 Curtis
4,393,614 A 7/1983 Pickett
4,625,620 A 12/1986 Harris
4,987,694 A 1/1991 Lombardo
5,029,407 A 7/1991 Kirkpatrick
5,081,782 A 1/1992 Wright
5,194,678 A 3/1993 Kramer
5,345,706 A * 9/1994 Brown ..... 42/94
5,347,740 A 9/1994 Rather et al.
5,937,560 A * 8/1999 Beltz ..... 42/94
6,875,161 B1 * 4/2005 Brice ..... 482/107

* cited by examiner

*Primary Examiner*—Michael J. Carone
*Assistant Examiner*—Benjamin P. Lee

(57) ABSTRACT

The adjustable firearm support of present invention works in combination with a firearm stock having a butt pad bolt or a stock built of sufficient materials to fasten to utilizing a common threaded fastener. This adjustable firearm support includes a support rod, base member, a positioning block, positioning pin and a support leg. The positioning block is pivotably received by the base member for rotating movement between a first retracted position and a second extended position for use. A locking mechanism allows an operator to selectively lock the adjustable firearm support in either the retracted or extended position. In one embodiment of the adjustable support, a base member is adapted to fit the generally upright inside surface of a fire arm stock so configured and employ a unique internally threaded socket bolt to capture and tighten up against a bolt which is carried by the firearm stock.

10 Claims, 3 Drawing Sheets

ADJUSTABLE FIREARM SUPPORT

CROSS REFERENCES TO RELATED APPLICATIONS

This application claims the benefit of U.S. Provisional Patent Application No. 60/573,978 filed May 24, 2004.

FIELD OF THE INVENTION

This invention relates to adjustable firearm support for adjustably supporting the stock of a rifle.

BACKGROUND OF THE INVENTION

Some rifles include stocks which have a generally upright interior surface which forward of the butt surface. Such rifles also have a longitudinal countersunk bore communicating between the upright interior surface and the butt surface for carrying a bolt for attaching accessories which are often mounted to the interior surface. Marksmen using rifles either as military snipers or as target shooters will often support the forward end of a rifle with a stationary bi-pod support and simultaneously support the butt end of the rifle in a way that provides fine adjustment of the elevation of the rifle. Accordingly, it is advantageous if an adjustable support is provided for rifles having an interior mounting surface as described above. Applicant's U.S. Pat. No. 5,248,868, which is incorporated here as if repeated verbatim hereafter, teaches an adjustable support for supporting the stock end of a rifle. The adjustable support taught in U.S. Pat. No. 5,248,868 is generally adapted for clamping to the type of firearm stock having sling stud imbedded in the lower surface of the firearm stock toward the butt end of the stock. It is also advantageous if an adjustable support can be rotated into a retracted position with a minimum of effort and conversely rotated into an extended position for use with a minimum of effort.

BRIEF DESCRIPTION OF THE INVENTION

In an embodiment of the present invention the aforementioned needs are addressed by an adjustable firearm support including a base member and an adjustable support leg. The base member is adapted for mounting to the upright inside surface of a firearm stock. More particularly, the base member includes a generally horizontal counter sunk bore for retaining a fastener for fastening to the inside surface of the firearm stock. Preferably, the firearm stock also includes a countersunk bore for retaining a bolt and the base member retains a unique internally treaded socket head fastener which engages the bolt retained by the firearm stock and thus fixes the base member against the inside upright surface of the stock. The support leg of the adjustable firearm support is connected to the base member portion by a positioning block. The positioning block is pivotably mounted within the base member for rotation between a first position and a second position. When the positioning block is in the first position, the attached adjustable support leg is in a first retracted position. When the positioning block is in the second position, the adjustable support leg is in a second, extended position for use. A spring biased positioning pin is also mounted within the base member. The spring biased positioning pin includes a relatively wide portion and a relatively narrow portion. The positioning block is located within the base member and shaped such that it can rotate without interfering with the narrow portion of the positioning pin when the positioning pin is urged sufficiently against its spring bias. The positioning block also has two recesses which are shaped and located to capture the wider portion of the positioning pin and thus lock the positioning block in either one of two desired positions preferably corresponding to either the first retracted position or the second extended position. When the wide portion of the positioning pin is captured by one of the spaced recess of the positioning block, a portion of the positioning pin protrudes from the base member so that the positioning pin can be manually urged against its bias and out of engagement by an operator. Thus, an operator, by pressing the protruding portion of the positioning pin, may selectively unlock the positioning block so that the positioning block may be quickly rotated to one of either the first retracted or second extended positions.

DETAILED DESCRIPTION

Figure 1:
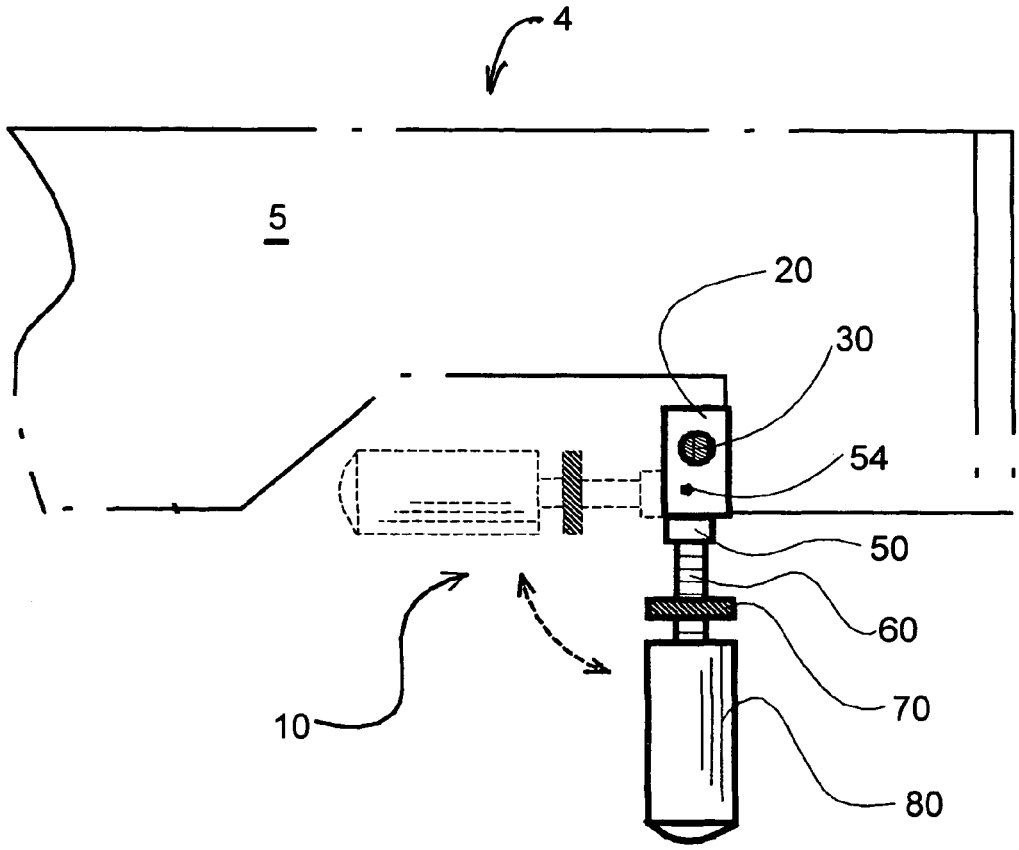
FIG. 1 is a side view of the adjustable firearm support of the present invention mounted to a firearm stock shown in reference

Referring to the drawings, FIG. 1 an adjustable firearm support 10 is mounted to a firearm stock 5 of a firearm 4. FIG. 1 is a side view of adjustable firearm support 10. As can be seen in FIG. 1, firearm stock 5 is of the type which includes a butt portion 5A and an interior, generally upright surface 5C. Adjustable firearm support 10 includes a base member 20, a positioning block 50, a support rod 60, a binding sleeve 70 and a support leg 80. Base member 20 is secured to upright surface 5C of firearm stock 5 using a fastener arrangement which will be described in detail below. As will also be described in greater detail below, support leg 80 is threadably mounted to support rod 60 so that it may be rotated to raise and lower firearm stock 5 in a finely adjustable manner for finely adjusting the elevation angle of firearm 4. As will be readily understood by the skilled reader, firearm stock 5 is preferably supported at its front end by a bi-pod or similar device. FIG. 1 shows support leg 80 and other elements in an extended position for use. Support leg 80 and other elements are also shown in phantom to illustrate a retracted position in FIG. 1.

Figure 2:
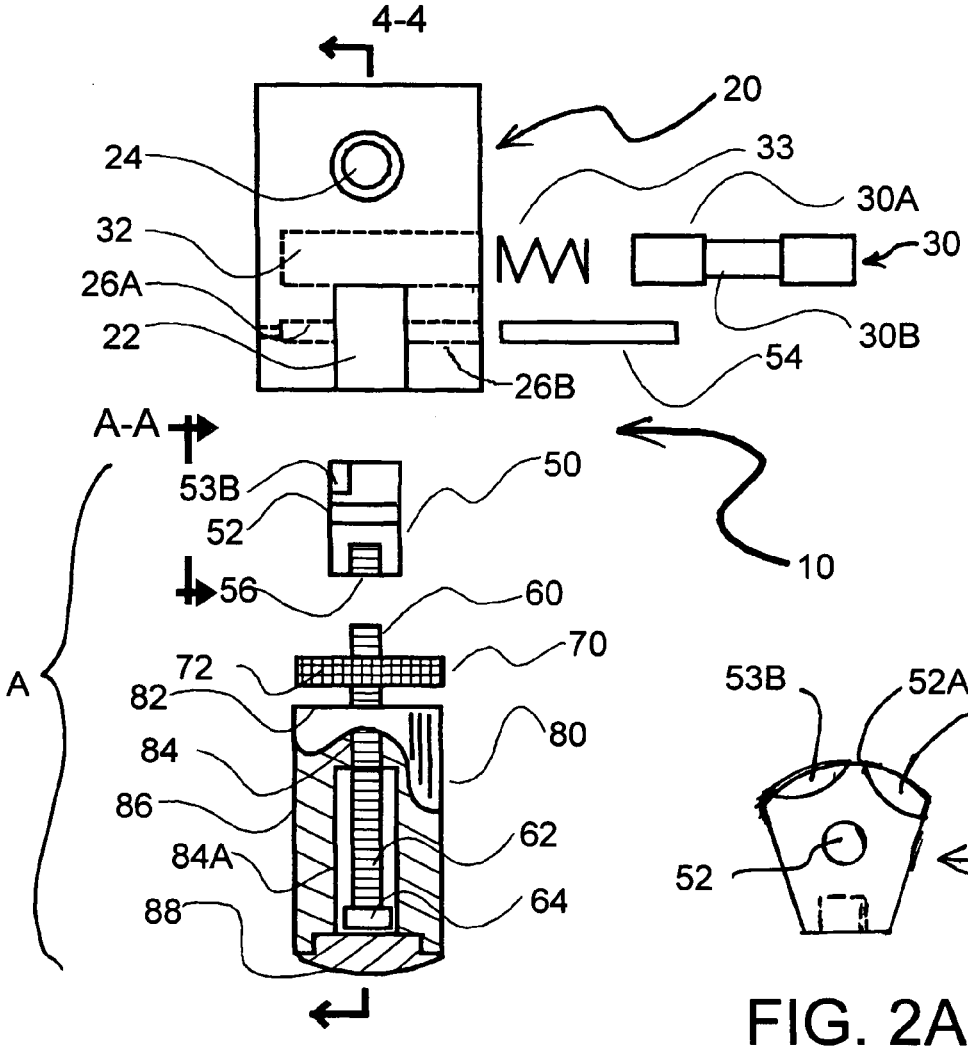
FIG. 2 is an exploded front view of the adjustable firearm support of the present invention.

FIG. 2 is an exploded view of the adjustable support 10 of the present invention. Adjustable support 10 is mounted to firearm 4 by base member 20. Support rod 60 is a threaded element which carries a binding sleeve 70 and support leg 80. Both binding sleeve 70 and support leg 80 have threaded bores for engaging the external threads of support rod 60. Positioning block 50 is for pivotably mounting support rod 60 and the elements carried by support rod 60 to base member 20.

Figure 3:
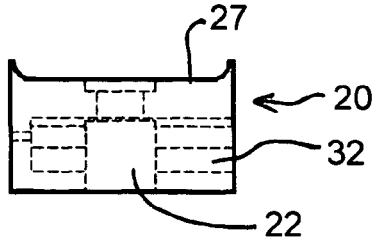
FIG. 3 is a top view of the base member 20.
Figure 4:
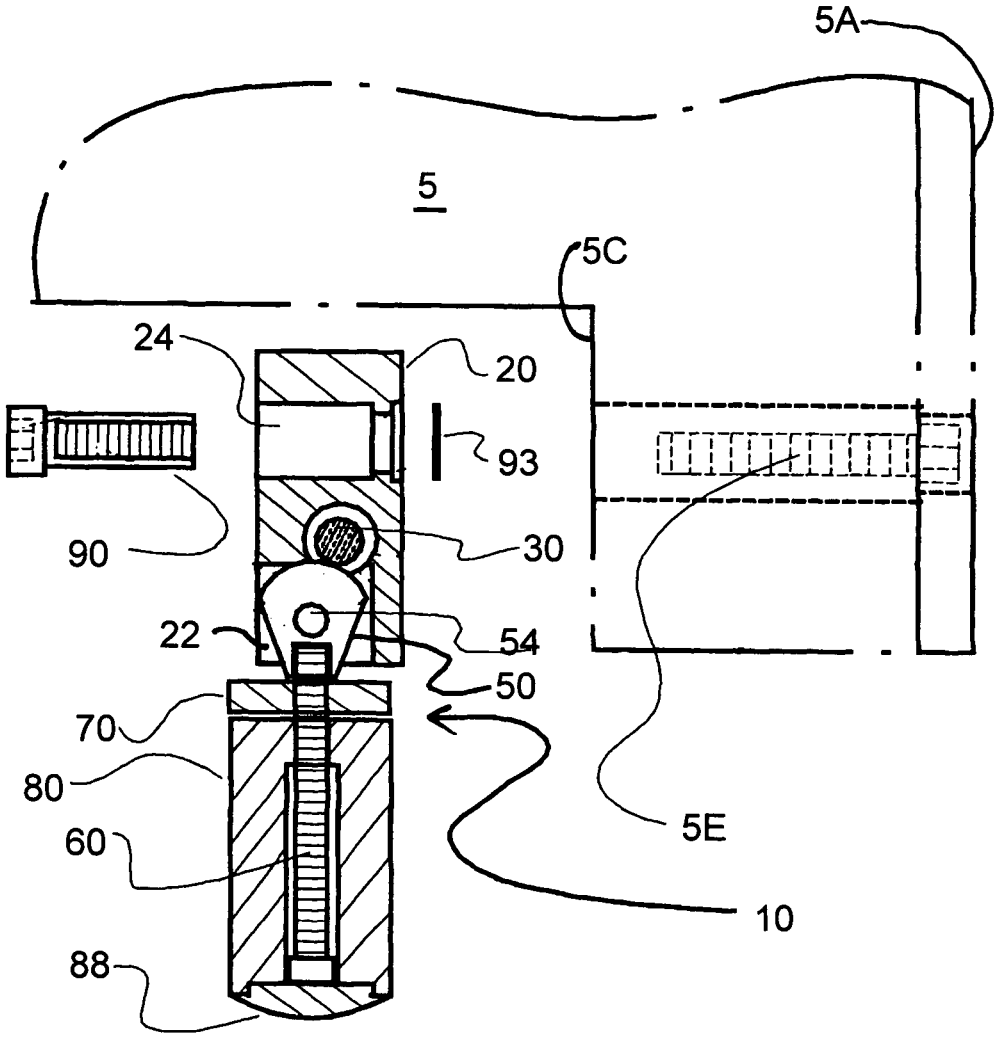
FIG. 4 is a section view taken from plane 4—4 indicated in FIG. 2

Base member 20 is shown in FIG. 2 and is shown in more detail in FIGS. 3 and 4. FIG. 2 shows a front view of base member 20. As can be seen in FIG. 2, base member 20 is rectangular in shape and is oriented such that its longest sides are generally upright. A generally horizontal counter bored hole 24 extends between opposite front and back surfaces of base member 20. A blind bored hole 32, is positioned under counter bored hole 24 and oriented generally perpendicularly with respect to counter bored hole 24. An axially aligned pair of holes 26A and 26B is generally parallel to and positioned under blind bored hole 32. A positioning block slot 22 extends from the back and bottom surfaces of base member 20 in a normal and intersecting relationship with both blind bored hole 32 and holes 26A and 26B. FIG. 3 is a top view of the base member 20 showing the cradle 27 which is shaped for fitting up against inside surface 5C of firearm stock 5 shown in FIG. 4. Positioning block slot 22 is shaped and sized for receiving positioning block 50. Positioning block 50 is pivotably mounted within within positioning block slot 22 by a positioning block pin 54. Bores 26A and 26B on opposite sides of positioning block slot 22 and a corresponding bore 52 in positioning block 50 are all axially aligned for receiving positioning block pin 54. Positioning block 50 has a threaded hole 56 in its lower surface for the fixed attachment of the upper threaded end of support rod 60.

Figure 2A:
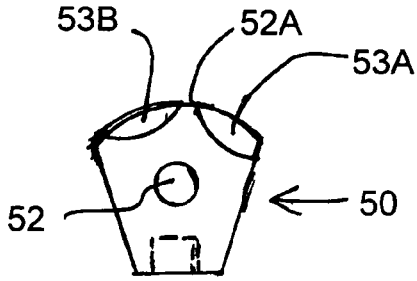
FIG. 2A is an enlarged side view of positioning block 50 taken from plane A—A indicated in FIG. 2.

As described above, positioning block 50 carries the pivoting portions of adjustable support 10, namely threaded support rod 60, binding sleeve 60 and support leg 80 which may be considered as an assembly indicated by reference character A in FIG. 2. Base member 20 and assembly A indicated in FIG. 2 are arranged such that assembly A may be selectively locked in either the retracted or extended positions shown in FIG. 1 or unlocked and rotated between those two positions. As described above, positioning block 50 is pivotably mounted within base member 20. Positioning block 50 and base member 20 cooperate within a releasable locking mechanism for selectively locking the pivoting portions of adjustable support 10 either in the first, raised position as shown in phantom in FIG. 1 or in the second extended or lowered position as shown with solid lines in FIG. 1. The releasable locking mechanism includes a positioning pin 30 which is received by a blind hole 32 in base member 20. Positioning pin 30 is biased to protrude from base member 20 by a spring 33 allow manual access by an operator. Positioning pin 30 includes a wide portion 30A toward its inserted end and a narrow portion 30B adjacent to wide portion 30A. As can be best seen in FIG. 2A, positioning block 50 includes a curved upper surface 52A which preferably describes a circular arc centered around the center of rotation of positioning block 50. Positioning pin 30 and positioning block 50 are arranged within base member 20 so that upper surface 52A of positioning block 50 clears narrow portion 30B of positioning pin 30 as positioning block 50 rotates. These elements are also arranged such that wide portion 30A of positioning pin 30 does not clear upper surface 52A of positioning block 50. Thus, when positioning pin 30 and positioning block 50 are installed in base member 20, positioning block 50 retains spring biased positioning pin 30. FIG. 2A is a side view of positioning block 50 taken from plane A—A indicated in FIG. 2. As can be seen in FIG. 2A, positioning block 50 includes two recesses, a first recess 53A and a second recess 53B. First and second recesses 53A and 53B are similarly shaped to receive a portion of wide portion 30A of positioning pin 30. Thus, when either first or second recess 53A or 53B captures part of the end of wide portion 30A, positioning block 50 is locked and can not rotate within base member 20. More particularly, when first recess 53A captures wide portion 30A, adjustable support 10 is locked in the first retracted position shown in phantom in FIG. 1. When second recess 53B captures wide portion 30A, adjustable support 10 is locked in the second extended position shown in solid lines in FIG. 1. Positioning pin 30 is arranged so that a portion of positioning pin 30 protrudes from base member 20 by a sufficient amount to allow an operator to depress the protruding end of positioning pin 30 against its spring bias and cause wide portion 30A to completely escape from either one of first or second recess 53A or 53B. Thus an operator, by depressing positioning pin 30 may unlock positioning block 50 so that adjustable support 10 may be rotated between the first retracted position and the second extended position described above. It is preferable that positioning pin 30 and positioning block 50 or at least their corresponding engaging surfaces in the above described locking arrangement be fashioned from a hard tough material such as hardened steel.

As can be seen in FIG. 2, support rod 60 includes a threaded shaft 62 and a bolt head 64. Support rod 60 can be fabricated from steel or brass or any material suitable for holding threaded surfaces. Support rod 60 could be easily fabricated from a socket head cap screw.

As can also be seen in FIG. 2, binding sleeve 70 includes a knurled portion 72 with an axial bore (not shown) which is threaded to receive the threaded shaft 62 of support rod 60. Binding sleeve 70 can be fabricated from steel or brass or any material suitable for holding knurled and threaded surfaces.

Support leg 80 is also shown in FIG. 2. It includes a top surface 82, a threaded axial bore 84, a counter bore 84A, a large handle body 86, and a rotation member 88. Large handle body 86 is designed to be easily manipulated by an operator. Threaded axial bore 84 is in a normal relationship to top surface 82 and is adapted to receive threaded portion 62 of support rod 60. Counter bore 84A extends from the bottom end of handle body 86 and meets threaded axial bore 84 near the center of handle body 86. Rotation member 88 closes off counter bore 84A and is adapted to turn on a stable surface. Support leg 80 can be made from a hard plastic capable of accepting internal threads or may have a metal insert for providing threaded axial bore 84.

FIG. 4 is a section view of the adjustable firearm support 10 taken from plane 4—4 of FIG. 2 with a firearm stock in relief. FIG. 4 shows the assembled adjustable firearm support 10 in relationship to a firearm stock 5 and a means for attaching adjustable firearm support 10 by utilizing a butt pad bolt 5E provided with firearm 4. An internally threaded socket head fastener 90 is used to engage butt pad bolt 5E and pull base member 20 tightly against inside surface 5C of firearm stock 5. Preferably, socket head fastener 90 should be of high strength steel capable of withstanding significant stress. Retaining clip 93 may be of common manufacture and configured to provide enough tension on internally threaded socket head fastener 90 to retain socket head fastener 90 within base member 20. In the absence of a butt pad bolt 5E, internally threaded socket head fastener 90 and retaining clip 93 are not required and adjustable firearm support 10 may be attached to firearm stock 5 by means of a common threaded fastener such as a socket head cap screw.

Adjustable firearm support 10 can be assembled as follows: First, support rod 60 is threaded into support leg 80 so that the bolt head 64 of support rod 60 is closely adjacent to top end of counter bore 84A of support leg 80. Second, rotation member 88 is pressed into the bottom of support leg 80. Third, binding sleeve 72 is threaded down onto support rod 60 until it is closely adjacent to top surface 82 of support leg 80. Forth, positioning block 50 is permanently threaded onto support rod 60 by use of thread locking compound thereby creating a permanent assembly indicated by A in FIG. 2. Fifth, spring 33 is placed into the bored blind hole 32 of the base member 20. Sixth, positioning pin 30 is pressed against poisoning spring 33 within blind bored hole 32. Seventh, and finally, the positioning pin 30 is depressed and positioning block 50 is inserted into positioning block slot 22 and is pivotably mounted to the base member 20 by pressing positioning block pivot pin 54 through the aligned holes 26A and 26B in base member 20 and hole 52 in positioning block 50.

Assembled adjustable firearm support 10 may be mounted to firearm stock 5 by means of socket head fastener 90 and butt pad bolt 5E as described above. As internally threaded socket head fastener 90 is threaded onto the butt pad bolt 5E, cradle 27 of base member 20 will firmly engage internal surface 5C of firearm stock 5. By depressing the positioning pin 30 against the bias of spring 33, an operator may disengage the wide portion 30A of positioning pin 30 from either recess 53A or 53B for movement between the first retracted position and the second extended position. Once adjustable firearm support 10 is locked in the second extended position as shown in FIG. 1 with solid lines, rotation member 88 of support leg 80 may be placed on a stable surface and support leg 80 may be rotated about support rod 60 to finely adjust the elevation of firearm stock 5.

It is to be understood that while certain forms of this invention have been illustrated and described, it is not limited thereto, except in so far as such limitations are included in the following claims and allowable equivalents thereof. equivalents thereof.

The invention claimed is:

1. An adjustable firearm support for attachment to a fire arm stock for adjusting the elevation of said firearm stock, comprising:

a support leg including a support rod having an upper end extending above the support leg, the length of the support leg being manually adjustable, a positioning block fixed to said upper end of said support rod, said positioning block having a generally circular arc shaped upper surface and at least one recess in said upper surface of said positioning block extending from one side thereof, a base member attached to said firearm stock, the base member including a positioning block slot for pivotably receiving said positioning block for pivoting about the center of said generally circular arc shaped upper surface thereof, such that said support leg may be pivoted into an extended position relatively normal to said firearm stock, said base member further including a positioning pin that is spring biased for protruding from said base member, said positioning pin including a wide portion and a narrow portion and disposed within said base member such that said narrow portion thereof clears said upper surface of said positioning block and also such that said wide portion thereof may be captured by said at least one recess in said generally circular arc shaped upper surface of said positioning block for locking said support leg against rotation thereof, whereby said positioning pin may be manually depressed against said spring to unlock said positioning block so that said support leg may be pivoted and whereby said positioning pin maybe subsequently released from manual pressure when said wide portion of said positioning pin and said at least one recess in said generally circular arc shaped upper surface of said positioning block are aligned to effect subsequent locking of said support leg.

2. The adjustable firearm support of claim 1 wherein, said firearm stock includes a generally upright inside surface and said base member includes a correspondingly shaped surface for fitting up against said generally upright inside surface and said base member includes a fastener means for fixing said correspondingly shaped surface against said generally upright inside surface of said firearm stock.

3. The adjustable firearm support of claim 1 further comprising;

a bolt carried by said firearm stock, said base member further including a countersunk hole for alignment with said bolt of said firearm stock and a an internally threaded socket head bolt for engaging said bolt carried by said firearm stock.

4. The adjustable firearm support of claim 1 wherein;

said firearm stock includes a generally upright inside surface and said base member includes a correspondingly shaped surface for fitting up against said generally upright inside surface and said base member includes a fastener means for fixing said correspondingly shaped surface against said generally upright inside surface of said firearm stock, said firearm stock further includes a bolt presented generally normally to said generally upright inside surface thereof, said base member further includes a countersunk hole for alignment with said bolt of said firearm stock and is attached to said firearm stock by an internally threaded socket head bolt for engaging said bolt carried by said firearm stock.

5. An adjustable firearm support for attachment to a fire arm stock for adjusting the elevation of said firearm stock, comprising:

a support leg including a support rod having an upper end extending above the support leg, the length of the support leg being manually adjustable, a positioning block fixed to said upper end of said support rod, said positioning block having a transverse hole, a generally circular upper surface centered around said transverse hole and a first recess and a second recess formed in said upper surface of said positioning block which both extend from one side thereof, a base member adapted for fastening to said firearm stock, the base member including a positioning block slot for receiving said positioning block, said base member having axially aligned holes on either side of said positioning block slot corresponding to said transverse hole of said positioning block for receiving a positioning block pivot pin for pivotably mounting said positioning block within said base member such that said support leg may be pivoted between a first retracted position relatively parallel to said firearm stock and a second extended position relatively normal to said firearm stock, said base member further including a blind bored hole for receiving a positioning pin and a spring for biasing said positioning pin to protrude from said base member for manual access by an operator, said positioning pin including a wide portion and a narrow portion, the blind bored hole located such that said narrow portion of said positioning pin clears said upper surface of said positioning block and also such that said wide portion of said positioning pin may be captured by said first recess in said upper surface of said positioning block for locking said support leg in said first retracted position, and such that said wide portion of said positioning pin may be captured by said second recess in said upper surface of said positioning block for locking said support leg in said second extended position, whereby said positioning pin may be manually depressed against said spring to unlock said positioning block so that said support leg may be pivoted between sad first retracted position and said second extended position and subsequently locked by manual release of said positioning pin to allow subsequent engagement of said wide portion of said positioning pin with one of said recesses of said positioning block.

6. The adjustable firearm support of claim 5 wherein, said firearm stock includes a generally upright inside surface and said base member includes a correspondingly shaped surface for fitting up against said generally upright inside surface and said base member includes a fastener means for fixing said correspondingly shaped surface against said generally upright inside surface of said firearm stock.

7. The adjustable firearm support of claim 5 further comprising;

a bolt carried by said firearm stock, said base member further including a countersunk hole for alignment with said bolt of said firearm stock and a an internally threaded socket head bolt for engaging said bolt carried by said firearm stock.

8. The adjustable firearm support of claim 5 wherein;

said firearm stock includes a generally upright inside surface and said base member includes a correspondingly shaped surface for fitting up against said generally upright inside surface and said base member includes a fastener means for fixing said correspondingly shaped surface against said generally upright inside surface of said firearm stock, said firearm stock further includes a bolt presented generally normally to said generally upright inside surface thereof, said base member further includes a countersunk hole for alignment with said bolt of said firearm stock and is attached to said firearm stock by an internally threaded socket head bolt for engaging said bolt carried by said firearm stock.

9. An adjustable firearm support for attachment to a fire arm stock for generally accurate, controlled raising and lowering of said firearm stock for improved elevation adjustment of said firearm, comprising:

a recessed bolt carried by said firearm stock, a support leg including a support rod having an upper end extending above said support leg and a means for generally fine, controlled adjustment of the length of said support leg, a base member for mounting the support leg to the firearm stock, the base member further including a countersunk hole for alignment with said recessed bolt of said firearm stock and a an internally threaded socket head bolt for engaging said recessed bolt carried by said firearm stock.

10. The adjustable firearm support of claim 9 wherein, said firearm stock includes a generally upright inside surface and said base member includes a correspondingly shaped surface for fitting up against said generally upright inside surface and said base member includes a fastener means for fixing said correspondingly shaped surface against said generally upright inside surface of said firearm stock.

* * * * *